US006948771B1

(12) United States Patent
Salandy

(10) Patent No.: US 6,948,771 B1
(45) Date of Patent: Sep. 27, 2005

(54) PORTABLE SEAT COVER

(76) Inventor: Lyndon Salandy, 454, Spring Garden, Dollard des Ormeaux, Quebec (CA) H9B 1T1

( * ) Notice: Subject to any disclaimer, the term of this patent is extended or adjusted under 35 U.S.C. 154(b) by 0 days.

(21) Appl. No.: 10/847,543

(22) Filed: May 18, 2004

(51) Int. Cl.[7] ..... A47C 31/00
(52) U.S. Cl. ..... 297/228.11; 297/220; 297/DIG. 6
(58) Field of Search ..... 297/188.13, 188.19, 297/220, 224, 228.11, 228.12, 228.13, 219.1, 297/DIG. 6, 118

(56) References Cited

U.S. PATENT DOCUMENTS

| | | | | |
|---|---|---|---|---|
| 2,793,683 | A * | 5/1957 | Trubitt | 297/224 |
| 3,804,458 | A | 4/1974 | Jannoni | |
| 4,232,898 | A | 11/1980 | Bodrero | |
| 4,273,380 | A * | 6/1981 | Silvestri | 297/188.06 |
| 4,725,094 | A * | 2/1988 | Greer | 297/229 |
| 5,005,901 | A * | 4/1991 | Hinde | 297/229 |
| 5,150,945 | A * | 9/1992 | Aupperlee et al. | 297/184.13 |
| 5,275,463 | A * | 1/1994 | Rocha | 297/229 |
| D359,411 | S * | 6/1995 | Wade | D6/610 |
| 5,573,288 | A * | 11/1996 | Raffensperger | 297/188.12 |
| 5,655,813 | A | 8/1997 | Kirkpatrick | |
| 5,707,107 | A * | 1/1998 | Melone | 297/228.1 |
| 5,709,431 | A | 1/1998 | Horn | |
| 5,806,925 | A | 9/1998 | Hanley | |
| D405,637 | S | 2/1999 | Licata et al. | |
| 6,309,017 | B1 | 10/2001 | Middleton | |
| 6,616,225 | B2 * | 9/2003 | Graff | 297/229 |

FOREIGN PATENT DOCUMENTS

| | | | |
|---|---|---|---|
| FR | 2725945 | * | 4/1996 |

* cited by examiner

*Primary Examiner*—Milton Nelson, Jr.

(57) ABSTRACT

A portable seat cover to cover the back of a variety of seats has drawstrings on its side to adjust to a variety of seat backs, a head rest that is stowable when there are no headrest to cover, and a built-in pouch into which can be folded the portable seat cover.

2 Claims, 2 Drawing Sheets

Figure 3:
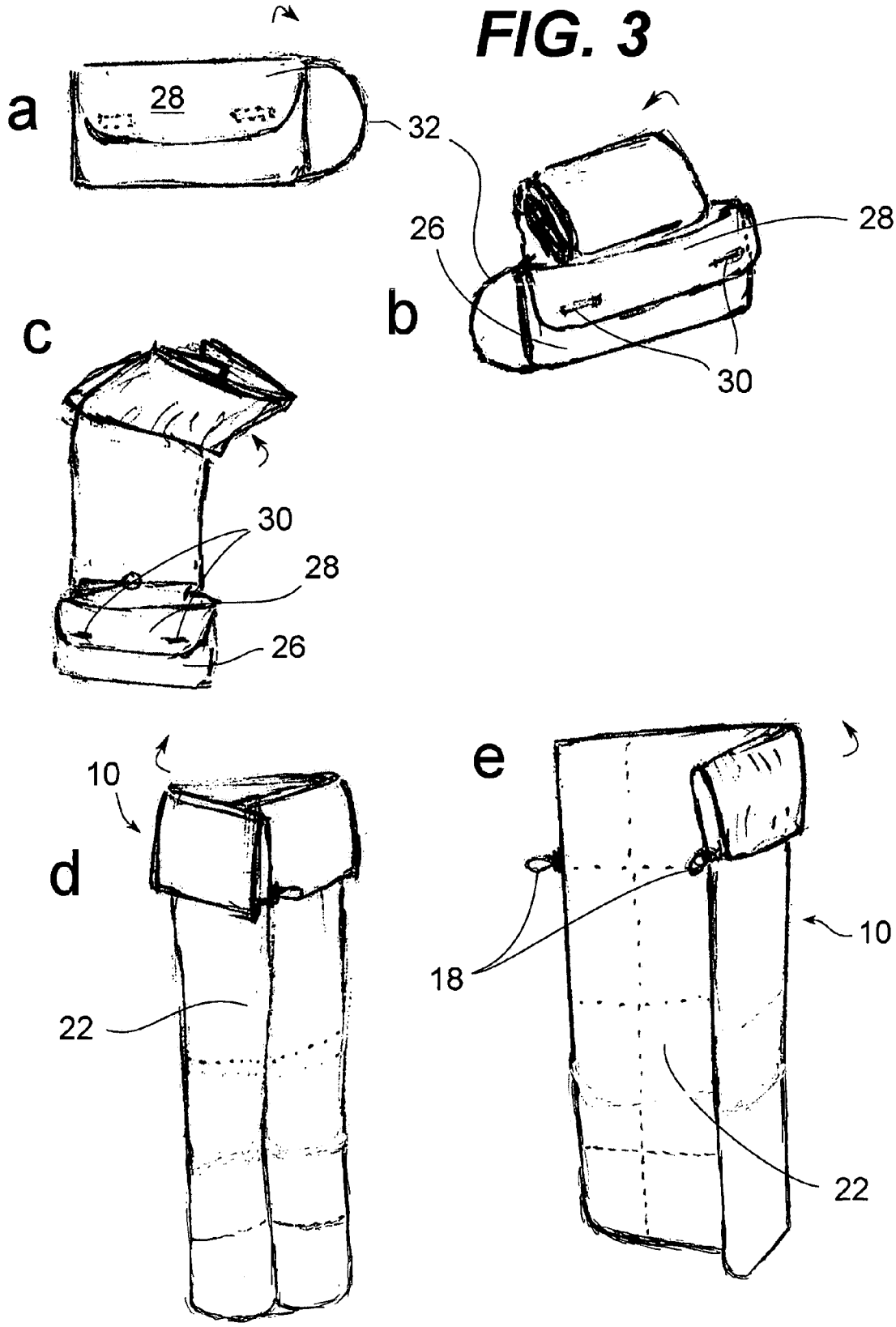

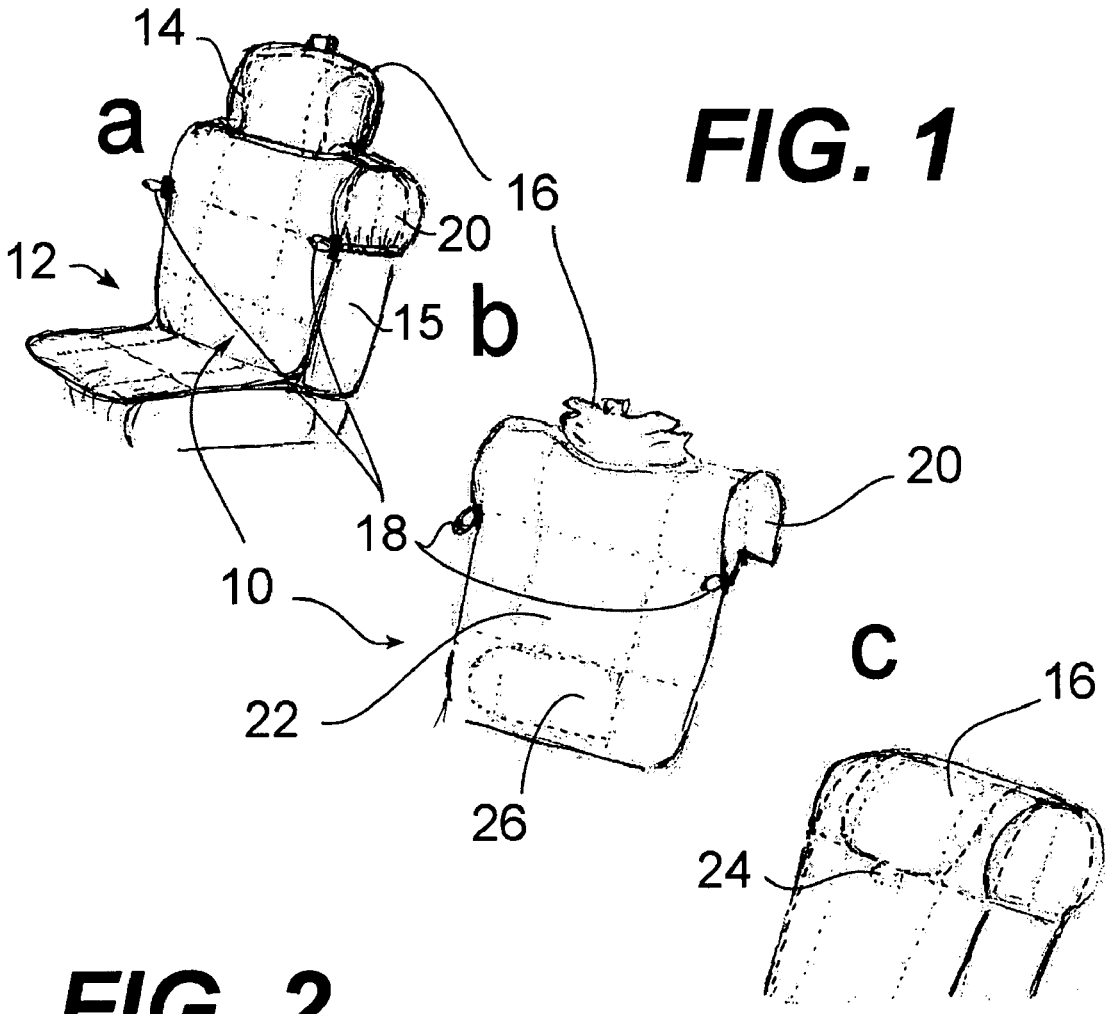
FIG. 1
FIG. 2
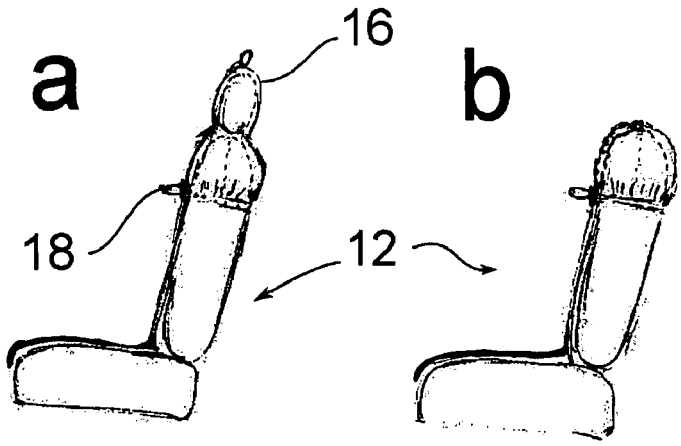

PORTABLE SEAT COVER

BACKGROUND OF THE INVENTION

1. Field of the Invention

The invention relates generally to covers but more particularly to a portable seat cover for use on cars, public transport, public and entertainment seating.

2. Backgound of the Invention

Seat covers, also known as slip covers have been around for a long time. Indeed, as a way of protecting or extending the useful life of seats or to protect the clothes of a seat user when seats are soiled, seat covers are very useful. Also to protect oneself from germs, mites, ticks, etc. . . .

Seat covers are divided in roughly two classes: permanent seat covers and temporary <<carry-on >> seat covers.

Carry-on seat covers of the prior art lack some features that would make using them more useful and pleasurable.

SUMMARY OF THE INVENTION

It is a first object of this invention to provide for a portable seat cover that is easy to install on a variety of seats.

It is a second object of this invention to provide for a seat cover that is foldable into its own built-in pouch for easy transport.

In order to do so, the portable seat cover has drawstrings on its side to adjust to a variety of seat backs; a head rest that is stowable when there are no headrest to cover; and a built-in pouch into which can be folded the portable seat cover.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE PREFERRED EMBODIMENT

FIGS. 1*abc* Perspective views of a portable seat cover installed on a seat with the head rest in use, the head rest not in use and the head rest reinserted and using hook and pile to set in place.

FIGS. 2*ab* Side elevations of a portable seat cover installed on a seat with the head rest in use and the head rest reinserted and using hook and pile to set in place.

FIGS. 3*a–e* The steps involved in the unfolding of the portable seat cover from its own built-in carrying pouch.

DETAILED DESCRIPTION OF THE PREFERRED EMBODIMENT

FIGS. 1*abc* In this series of perspective views, a portable seat cover (10) is seen in context, installed on a seat (12), more specifically a back of a seat (15), with a head rest section (14) set to cover a seat head rest (16) and a back rest section (22) covering the back of the seat (15). In order to properly fit over the seat (12), the portable seat cover (10) is slipped over the back of the seat (15) and a pair of drawstrings (18) are drawn so as to tightly adjust to the back of the seat (15). The drawstrings (18) are situated towards the upper extremity of the back rest section (15) in an area referred to as the wraparound section (20) since it wraps around the back of the seat (15). When there are no seat head rest (16), such as in FIGS. 1*bc*, the head rest section (14) can be reinserted so as to be tucked away and held in place using a head rest section closure means (24) such as hook and pile or any such type of closure.

FIGS. 3*a–e* The 3 steps involved in the setting up the portable seat cover (10) onto a seat (12) consist in:

1) Opening a closing flap (28) of a built-in pouch (26) as per FIGS. ab, which can be equipped with a carrying handle (32). The flap (28) has a closure means (30) such as, but not limited to, hook and pile.
2) The seat cover (10) is then unrolled from the pouch (26) as per FIG. 3*c*.
3) The seat cover (10) is then unfolded along the length of its back rest section (22) as in FIGS. 3*de*, installed over the back of the seat (15) as per FIG. 1, and drawstrings (18) pulled to tightly adjust to the back of the seat (15).

What is claimed is:

1. A portable seat cover for covering a seat and comprising:

a head rest section for covering a seat head rest;

a back rest section to cover a back of a seat;

a wraparound section for wrapping around said back of a seat;

drawstrings situated on said wraparound section to tighten said wraparound section around said back of a seat;

a built-in pouch with a closing flap;

said built-in pouch having a carrying handle;

said head rest section having a head rest section closure means so that said head rest section can be tucked away and held in place.

2. A portable seat cover for covering a back of a seat as in claim 1 wherein:

said closure means being hook and pile means.

* * * * *